US006171359B1

(12) United States Patent
Levinski et al.

(10) Patent No.: US 6,171,359 B1
(45) Date of Patent: Jan. 9, 2001

(54) POWDER MIXTURE FOR THERMAL DIFFUSION COATING

(76) Inventors: Leonid Levinski, Ave. Parmentier 150, B-150, Bruxelles (BE); Samoilov Victor, Vernadsky Prospect, 9-373, Moscow 117311 (RU); Shtikan Isaak, Bilu St.6, Petach Tikva, 49462; Sheinkman Avraham, Derech Efron 5/4, Ariel 11476, both of (IL)

( * ) Notice: Under 35 U.S.C. 154(b), the term of this patent shall be extended for 0 days.

(21) Appl. No.: 09/380,764

(22) PCT Filed: Mar. 15, 1998

(86) PCT No.: PCT/IL98/00121

§ 371 Date: Nov. 18, 1999

§ 102(e) Date: Nov. 18, 1999

(87) PCT Pub. No.: WO98/41346

PCT Pub. Date: Sep. 24, 1998

Related U.S. Application Data

(60) Provisional application No. 60/041,259, filed on Mar. 17, 1997.

(51) Int. Cl.[7] ..... B22F 1/00

(52) U.S. Cl. ..... 75/252; 427/376.4; 428/640

(58) Field of Search ..... 75/252; 427/453, 427/185, 376.4; 428/640

(56) References Cited

U.S. PATENT DOCUMENTS

| | | | | |
|---|---|---|---|---|
| 3,436,511 | | 4/1969 | Rath . | |
| 3,864,093 | | 2/1975 | Wolfla . | |
| 4,124,737 | | 11/1978 | Wolfla . | |
| 4,313,760 | | 2/1982 | Dardi et al. . | |
| 4,822,689 | | 4/1989 | Fukubayashi et al. . | |
| 4,917,966 | * | 4/1990 | Wilde et al. | 428/659 |

* cited by examiner

*Primary Examiner*—Ngoclan Mai
(74) *Attorney, Agent, or Firm*—Blank Rome Comisky & McCauley LLP

(57) ABSTRACT

A powder mixture suitable for use in providing a corrosion resistant coating on metal surface by thermal diffusion coating process. The powder mixture comprises a base metal powder of 0.1–5 wt. % of an additive consisting of at least one oxide of transition metals having particle size preferably of not more than 1 micron.

15 Claims, No Drawings

POWDER MIXTURE FOR THERMAL DIFFUSION COATING

This application claim benefit to Provisional application No. 60/041,259 filing date Mar. 17, 1997.

FIELD OF INVENTION

The present invention relates to the surface treatment technology of metal articles with the purpose of receiving on their surface protecting and decorative coatings.

In particular, this invention relates to the thermal diffusion coating technology for receiving protecting and decorative coatings on metal surface by virtue of thermal activation of atoms surrounding that surface and their induced diffusion thereinto.

In the industry the process of such kind is known for Zinc saturation of metallic surfaces consisting of iron or iron alloys This process is known in the art as "sherardizing" (named after its English inventor Sherard O. Cowper-Coles).

The process is carried out by heating up to 380–450 degrees of Celsius of iron made articles embedded within zinc-containing powder mixture.

The resulting diffusion coating consists of inter-metallic compounds and such coatings are defined by improved corrosion stability compared to coatings received by alternative technologies, e.g. electroplating or hot-dipping.

BACKGROUND OF INVENTION

A general description of the sherardizing process can be found in monographs or handbooks, for example, "Corrosion and Protection of Metals" by Bakhvalov and Turkovskaya, Pergamon Press, 1965, or "Zincification", handbook edited by Proskurkin, Moscow, Metallurgy, 1988.

The typical sherardizing process is described in these and others handbooks, as including the following general steps:

- preparing of articles surface by chemical or shot blasting treatment;
- placing of cleaned articles into a drum, filled with zinc powder and inert filler zinc oxide, sand, aluminum oxide and others). The amount of inert filler and zinc powder can be varied from 1:10 to 1:1;
- sealing of the drum and heating up to the temperature within the range 380–450 degrees of Celsius and isothermal heating for 1–4 hours;

In order to accelerate the process the drum can be rotated with a small velocity;

After completing the heating step the coated articles are discharged from the drum and transferred to finishing operation, usually passivation.

The coating received by this process consists of several phases, defined by different zinc-iron ratio depending on heating temperature and time and composition of zinc-containing mixture. The coating may have thickness from 5 to 200 and more microns. The coating color is usually gray, and after passivation it becomes dark-gray.

The problem with which usually is associated with sherardizing is melting and coalescence of zinc powder particles due to the fact that Zn melting point is close to the process temperature. Usually this problem is solved by introducing into mixture of an inert additive, providing for physical barrier between the Zinc particles or creating this barrier artificially on the surface of Zn particles.

In SU 1534091 there is disclosed steam-oxidation treatment of Zn powder resulting in creating on Zn particles oxides and hydroxides preventing melting of adjacent particles together. In SU 560001 there is disclosed sherardizing, which is carried out in within the powder mixture, consisting of (wt. %): Cr 10–20, Zn 10–20, silicon oxide 10–15, chromic oxide 10–20, $NH_4Cl$ 1–3, remainder $Al_2O_3$.

In CN 1084582 there is described sherardizing mixture consisting of Zinc, guarzite and small additions of Pb.

The above mentioned approach based on introduction of inert additives into sherardizing mixture overcomes the above mentioned problem and is widely used in industry.

It should be pointed out however that sherardizing within powder mixtures with inert additivies does not improve corrosion resistance in comparison with coatings deposited by alternative technologies and does not allow to control the coating color.

For example corrosion resistance of coatings obtained by sherardizing are worse in conditions of Salt-Spray (the standard environment for determination corrosion stability of coatings) that zinc coatings deposited electrolytically. Despite some improvement of corrosion resistance can be achieved after passivation, it does not always satisfy customers requirements and besides the passivation is associated with deterioration of coating visual appearance because its color becomes dark-gray.

In FR 2451405 there is described that in order to impart brilliance to an article after sherardizing process it is treated by phosphatization and then is polished It should be realized however that in order to provide such a coating with reasonable corrosion resistance it should be passivated. Seeing that passivation results in a colorless pasivating film it can be readily understood that after passivation the brilliant appearance will be lost. It should be also mentioned that phosphatizing with subsequent polishing doesn't provide for an opportunity to control the coating color.

OBJECTS & SUMMARY OF THE INVENTION

The main object of the present invention is to provide for a new zinc-containing powder mixture for sherardizing process and a method for its preparation in which the above mentioned drawbacks are sufficiently reduced or overcome.

In particular, the first object of the present invention is to provide for a new and improved zinc-containing powder mixture for use in sherardizing process which enables receiving of colored coatings with wide range of color and with improved corrosion resistance.

The second object of the present invention is to provide for a simple and cheap method of preparation of such a mixture.

The above and other objects and advantages of the present invention can be achieved in accordance with the following combination of its essential features referring to different embodiments thereof.

A powder mixture comprising a base metal powder suitable for use in thermal diffusion coating process in which an article to be coated is embedded into said powder mixture and is thermally treated therein so as to cause diffusion of atoms of said base metal within said article, characterized in that said powder mixture comprises 0.1–5 wt. % of an additive consisting of at least one oxide of a metal chosen from the group comprising iron, titanium, chromium, cobalt, nickel, molybdenum, said additive having a particle size not more than 5 micron, and preferably less than 1 micron.

It has been found that by virtue of the above additive it is possible to receive colored coatings with increased corrosion resistance in conditions of Salt Spray Chamber by 50–100%. It should be pointed out that improvement of corrosion resistance and coloration effect does not take place on account of the coating thickness.

The present invention in its various embodiments has only been briefly summarized.

For a better understanding of the present invention as well as its advantages, reference will now be made to the following description of its embodiments.

DETAILED DESCRIPTION OF PREFERRED EMBODIMENTS

In accordance with the present invention fine particles of oxides of certain transitional metal are firmly adhered to the surface of zinc-iron coating thus providing it with color and improving its corrosion resistance.

It has been established empirically that for this purpose especially suitable are oxides of metals chosen from the group consisting of iron, titanium, chromium, cobalt, nickel, molybdenum The above oxides should have a particle size not more than 5 microns and preferably less than 1 micron.

Particles of transitional metal oxides or their combinations are introduced into zinc-containing mixture during preparation thereof before carrying out the sherardizing process.

It has been empirically found that in order to achieve colored coating having improved corrosion resistance and good adhesion the amount of above fine additive within the mixture should be 0.01–5 wt. %.

The invention will be described in the following non-limiting examples.

In these examples the following commercially available products were used:

- Zinc powder, manufactured by ZINCOLI P.O.B. 20, Cockerillstrasse 69, D-51990 Stolberg, Germany, contains 99% of metallic Zinc, the powder particle size ranges between 20 and 60 micrometers;
- Chromium oxide $Cr_2O_3$, manufactured by Harcros Chemical Group British Chrome & Chemical, Urlay Nook, Eaglesliffe, Stockton-on-Tees, Cleveland TS 16 OQG, UK. The fraction with particles size not more than 1 micron and containing not less than 99% $Cr_2O_3$ was used;
- Titanium oxide of technical grade, was supplied by Chemorad Chemicals Ltd., Tel-Aviv, Haracevet St., 22, 66183 Israel. The average size of particles was 0.4 micron, content of titanium oxide not less than 96%;
- Composition (Ti Cr, Sb)$O_2$ was supplied by MYKO Eng. Ltd., P.O.B. 43, Kefar-Saba, 44100 Israel. The average particle size was 0.3 micron, content of main constituent more than 99%.
- CoO powder having particle size less than 0.8 micron was supplied by Harcros Chemical Group British Chrome & Chemical, Urlay Nook, Eaglesliffe, Stockton-on-Tees, Cleveland TS 16 OQG, UK.

Experimental procedure

Content of metallic Zinc in the saturating mixture was determined by volume of hydrogen produced during solution of the powder in hydrochloric acid;

Coating thickness was determined by MINITEST-500 device;

Adhesion of colored layer was determined by tearing off of a sticking tape in accordance with the standard ASTM B571;

Corrosion resistance was determined in Salt Spray Chamber in accordance with the ASTM B117-94 and was estimated by the time required for appearance of yellow spots;

Diffusion coating was carried out in commercially available machine MDS-90, manufactured by Distek (1993) Ltd., P.O.B. 1829 Ariel, 44837 Israel. Conditions of the process were: saturation temperature 400 degrees C saturation time 1 hour.

The zinc-containing powder mixture for diffusion coating was prepared in accordance with SU 1534091. The amount of base Zn metal was 87% and amount of inert filler was 13%.

Coated articles were passivated at room temperature during 10 minutes in solution of ZnO, 15 g./l of $H_3PO_4$, 2 g./l of $NaNO_3$.

Standard samples with dimensions 76×127×0.8 mm were used for testing.

EXAMPLE 1

Machine MDS-90 was charged with 1.5 kg of saturating mixture, 80 g of chromium oxide, 26 kg of washers and 4 kg of standard samples. Diffusion coating process was carried out at 350–450 degrees C for 1–4 hours.

EXAMPLE 2

Similar to example 1, but instead of chromium oxide there was added 15 g of titanium dioxide.

EXAMPLE 3

Similar to example 1, but instead of chromium oxide there was used 40 g of cobalt oxide CoO.

EXAMPLE 4

Similar to example 1, but instead of chromium oxide there was used 60 g of (Ti Cr, Sb)$O_2$.

EXAMPLE 5

Similar to example 1, but instead of 80 g of chromium oxide there was used 6 g of chromium oxide.

EXAMPLE 6

Similar to example 1, but instead of 80 g chromium oxide there was loaded 90 g of chromium oxide.

EXAMPLE 7

Similar to example 1, but chromium oxide had particle size 5–10 microns.

Results of tests carry out on coatings received in examples 1 are summarized in the table 1 below.

TABLE 1

| Example number | Coating thickness, micron | Color | Stability in Salt Spray Chamber, hours | Adhesion |
|---|---|---|---|---|
| Initial powder without additions | 60 | dark-gray | 96 | — |
| 1 | 60 | green | 192 | green layer can't be removed by sticking tape |
| 2 | 60 | light gray | 146 | white layer not removable by sticking tape |

TABLE 1-continued

| Example number | Coating thickness, micron | Color | Stability in Salt Spray Chamber, hours | Adhesion |
|---|---|---|---|---|
| 3 | 60 | brown | 168 | brown layer can't be removed by sticking tape |
| 4 | 60 | yellow uniform | 192 | can't be removed by sticking tape |
| 5 | 60 | green not uniform | 96 | can't be removed by sticking tape |
| 6 | 60 | green not uniform | 192 | is partly removable by sticking tape |
| 7 | 60 | green uniform | 144 | is removable by sticking tape |

As can be seen from the above results coloration of thermal diffusion coatings can be achieved with simultaneous improvement of corrosion resistance if the saturation mixture contains not less than 0.1–5 wt. % of fine metal oxide with particle size not more than 1 micron. If the concentration is more than 5 wt. % or if the powder size of oxide is coarser than 1 micron the layer does not adhere.

It should be understood that the present invention should not be limited to the above described examples and embodiments. Changes and modifications can be made by one ordinarily skilled in the art without deviation from the scope of the invention.

For example addition of fine oxides can be implemented not only for thermal diffusion of iron but for obtaining diffusion coatings on aluminum, copper or other metals.

The saturation mixture can contain atoms of other base metals, like aluminum, chromium etc.

Fine additives of oxides can be added to metal powder mixture containing in addition to base metal also additive of inert fillers.

The saturation mixture can contain mixture of fine oxides.

We claim:

1. A powder mixture comprising zinc powder and an additive for use in a thermal diffusion coating process, said additive comprises 0.1–5 wt. % of at least one oxide of a metal chosen from the group consisting of iron, titanium, chromium, cobalt, nickel, molybdenum, said additive having a particle size of not more than 5 microns.

2. The powder mixture of claim 1, wherein said additive has a particle size of less than 1 micron.

3. The powder mixture of claim 1, wherein said zinc powder has a particle size ranging from about 20 to 60 micrometers.

4. The powder mixture of claim 1, wherein said additive has a particle size of less than 1 micron.

5. A method of thermally diffusing zinc into a ferrous substrate comprising the steps of:

providing a powder mixture as recited in claim 1;

coating said ferrous substrate with said powder mixture; and heating said coated substrate for an effective time to cause diffusion of said zinc into said substrate.

6. The method of claim 5, wherein said diffusion coating is carried out at a temperature of between about 350–450° C.

7. The method of claim 5, wherein said additive has a particle size of not more than 1 micron.

8. The method of claim 7, wherein said zinc particle size ranges from about 20 to 60 micrometers.

9. A coated article made in accordance with the method of claim 5.

10. The powder mixture of claim 1, wherein said additive is an oxide of iron.

11. The powder mixture of claim 1, wherein said additive is an oxide of titanium.

12. The powder mixture of claim 1, wherein said additive is an oxide of chromium.

13. The powder mixture of claim 1, wherein said additive is an oxide of cobalt.

14. The powder mixture of claim 1, wherein said additive is an oxide of nickel.

15. The powder mixture of claim 1, wherein said additive is an oxide of molybdenum.

* * * * *